United States Patent [19]

Kobayashi et al.

[11] Patent Number: 4,678,072

[45] Date of Patent: Jul. 7, 1987

[54] BILL VALIDATING AND ACCUMULATING DEVICE

[75] Inventors: Osamu Kobayashi; Masaki Akagawa; Hiroshi Hayashi, all of Saitama, Japan

[73] Assignee: Nippon Coinco Kabushiki Kaisha, Tokyo, Japan

[21] Appl. No.: 656,585

[22] Filed: Oct. 1, 1984

[30] Foreign Application Priority Data

Oct. 3, 1983 [JP] Japan ..... 58-184848

[51] Int. Cl.[4] ..... G07F 7/04

[52] U.S. Cl. ..... 194/206; 209/534; 271/181; 100/52

[58] Field of Search ..... 209/534; 194/4 C, 4 B, 194/4 D, 4 E, 4 G, 206, 207; 271/177, 180, 181, 213, 214; 100/52; 221/21, 267, 281

[56] References Cited

U.S. PATENT DOCUMENTS

| | | | |
|---|---|---|---|
| 3,148,879 | 9/1964 | Kistner | 271/181 X |
| 3,613,560 | 10/1971 | Bottas et al. | 100/52 |
| 3,627,094 | 12/1971 | Kaufman et al. | 194/97 R |
| 3,655,186 | 4/1972 | Bayha | 194/4 E X |
| 3,917,260 | 11/1975 | Okkonen et al. | 194/206 X |
| 3,918,359 | 11/1975 | Hennells et al. | 100/52 |
| 4,011,931 | 3/1977 | Wyckoff | 194/4 C |
| 4,045,017 | 8/1977 | Lundblad | 194/4 E X |
| 4,088,071 | 5/1978 | Cruse et al. | 100/52 X |
| 4,428,503 | 1/1984 | Martin | 221/281 X |
| 4,540,081 | 9/1985 | Mori et al. | 194/207 |

FOREIGN PATENT DOCUMENTS

| | | | |
|---|---|---|---|
| 2453811 | 12/1980 | France | 194/4 C |
| 52-27700 | 3/1977 | Japan | 194/4 C |
| 0012043 | 1/1984 | Japan | 271/180 |
| 2017657 | 10/1979 | United Kingdom | 271/214 |

*Primary Examiner*—Joseph J. Rolla
*Assistant Examiner*—Edward S. Ammeen
*Attorney, Agent, or Firm*—Spensley Horn Jubas & Lubitz

[57] ABSTRACT

The bill device comprises a main part made of an elongated casing. A bill insertion slit is formed at an end portion of a front panel of the casing and a bill conveying passage of an L-shape is provided in the casing and communicates with the bill insertion slit for conveying a bill in the longitudinal direction. A bill discrimination device is provided in a short straight portion of the bill conveying passage nearer to the bill insertion slit and a reciprocating mechanism is provided on one side of a long straight portion of the bill conveying passage for effecting a bill accumulating operation. A bill accumulating box is provided on the other side of the long straight portion of the bill conveying passage for accumulating bills pressed toward it by the reciprocating mechanism.

7 Claims, 5 Drawing Figures

BILL VALIDATING AND ACCUMULATING DEVICE

BACKGROUND OF THE INVENTION

This invention relates to a bill device used in a vending machine, an exchange or the like device.

A bill device generally comprises a bill discrimination device for discriminating a true bill from a counterfeit one among inserted bills and accepting only true bills and a bill accumulating device for receiving and storing the accepted true bills. In conventional bill devices, a bill conveying passage leading from a bill insertion slit to the bill accumulating device is made in straight or gradually curved configuration with a result that the size of the bill device tends to become large to house the bill conveying passage of such configuration.

It is, therefore, an object of the invention to provide a bill device which is of a compact construction and still has minimum required functions as a bill device.

SUMMARY OF THE INVENTION

The bill device according to the present invention is characterized in that it comprises a main part made of an elongated casing, a bill insertion slit formed at an end portion of a front panel of the casing, a bill conveying passage of an L-shape provided in the casing and communicating with the bill insertion slit for conveying a bill in the longitudinal direction, bill discrimination means provided in a short straight portion of the bill conveying passage nearer to the bill insertion slit, reciprocating means provided on one side of a long straight portion of the bill conveying passage for effecting a bill accumulating operation and a bill accumulating box provided on the other side of the long straight portion of the bill conveying passage for accumulating bills pressed toward it by the reciprocating means. By forming the bill conveying passage in the L-shape, the length of the casing can be shortened as compared with a case wherein a straight bill conveying passage is provided. The length of the casing as well as the size of the whole device can be made small also as compared with a case wherein a gradually curved bill passage is provided.

BRIEF DESCRIPTION OF THE DRAWINGS

In the accompanying drawings.

DESCRIPTION OF A PREFERRED EMBODIMENT

Figure 1:
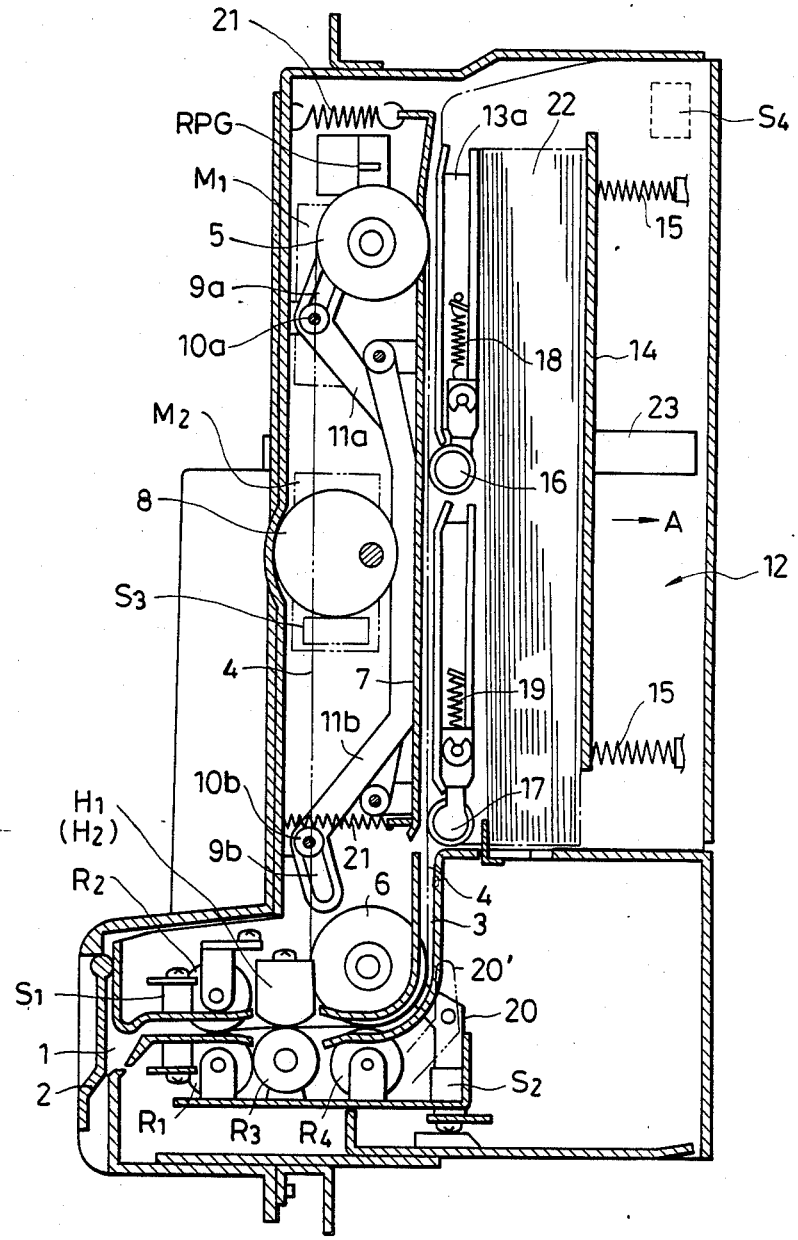
FIG. 1 is a sectional side view showing an embodiment of the bill device according to the invention.

Referring to FIG. 1, a main part of the bill device according to the invention consists of a vertically elongated casing. A bill insertion slit 1 is formed in the lower portion of a front panel (the left side as viewed in the figure) of the casing. A cover 2 is lifted up and a bill is inserted into the bill insertion slit 1. In the casing, there is provided a bill conveying passage 3 of an L-shape which communicates with the bill insertion slit 1 and conveys a bill in the longitudinal direction. In a short straight portion of the L-shaped passage 3 near the bill insertion slit 1, there are provided magnetic heads H1 and H2 for discriminating true bills from false ones. The magnetic heads H1 and H2 are provided in a pair on both sides of a center line and detect magnetic contents contained in the bill printing ink. A bill sensor S1 is provided near the bill insertion slit 1 for detecting insertion of a bill.

In the bill conveying passage 3, there are provided a pair of bill conveying belts 4, a conveying motor M1 for driving these belts 4 and pairs of pulleys 5 and 6 for transmitting the rotation of the motor M1 to the belts 4. The rotation of the motor M1 is transmitted to the upper pair of pulleys 5 and the lower pair of pulleys 6 are driven by the rotation of the pulleys 5. The lower pulleys 6 are provided in the corner portion of the L-shaped passage whereas the upper pulleys 5 are provided in the upper end portion of the passage 3. The belts 4 are stretched over the long straight portion of the L-shaped passage 3 from the corner portion thereof, the driving force of the conveying motor M1 being exerted to the bill in this portion of the bill passage 3. There is also provided a rotation pulse generator RPG which generates an electrical pulse signal in synchronism with the rotational position of the conveying motor M1. This pulse signal is used for preparing bill position address data in performing the discrimination of true bills from false ones on the basis of outputs of the magnetic heads H1 and H2. More specifically, the magnetism distribution on the surface of a bill indicates a specific pattern corresponding to respective address positions on the bill so that the discrimination of bills denomination by denomination can be made by utilizing this pattern. Reference characters R1, R2, R3 and R4 denote driven rollers.

On one side of the long straight portion (on the side of the conveying belts 4) of the L-shaped bill conveying passage 3, there is provided reciprocating means for effecting the bill accumulating operation. This reciprocating means comprises a push plate 7 for pushing the bill which has been brought by the conveying belt 4 in the direction of the face of the bill and a mechanism for reciprocating this push plate 7 in accordance with the rotation of a motor M2. There are provided a pair of offset cams 8 mounted eccentrically on the rotation shaft of the motor M2 and a pair of link levers 11*a*, 11*b* which are pivotally connected at one ends to the push plate 7 and connected at the other ends to fixed pins 10*a* and 10*b* through slots 9*a* and 9*b*. As the motor M2 rotates, the cams 8 rotate eccentrically to push the link levers 11*a* and 11*b* thereby moving the push plate 7 in a translating motion in the direction of the face of the bill. The push plate 7 is always biased toward the cams 8 by a spring 21 so that the push plate 7 reciprocates in association with the eccentric rotation of the cams 8.

Figure 2:
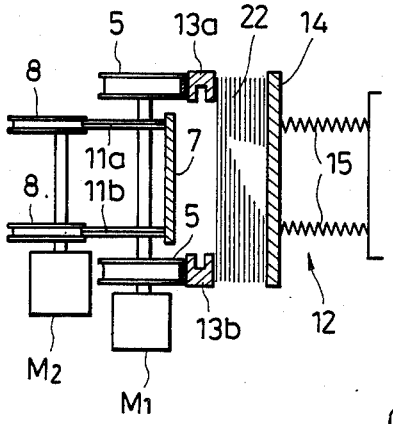
FIG. 2 is a view schematically showing, in a cross section, the same embodiment during a bill accumulating operation.

On the other side of the long straight portion of the L-shaped passage 3, there is provided an accumulating box 12 for accumulating bills pushed thereinto by the above described reciprocating means. As shown in FIG. 2, the accumulating box 12 has an entrance formed by vertically elongated channel members 13*a* and 13*b* which are vertically disposed in parallel with each other with predetermined space therebetween which is somewhat narrower than the width of the bill. A bill compressing plate 14 having breadth corresponding to the size of the bill is provided in parallel with the channel members 13*a* and 13*b* and the push plate 7. While the channel members 13*a*, 13*b* are fixedly disposed, the bill compressing plate 14 is movable in a translating motion in a normal direction to the surface of the plate and is always urged to the channel members 13*a* and 13*b* by the force of a spring 15 which is provided in a suitable manner. Portions of the channel members 13*a* and 13*b* on the side of the bill conveying passage 3 are partially recessed and driven rollers 16 and 17 for assisting feeding of bills are provided in the recessed portions. These rollers 16 and 17 are always urged to the belts 4 by the force of springs 18 and 19 and are driven by the bill while they hold the bill, which is fed thereto by the movement of the belts 4, between them and the belts 4.

In a standby state, the reciprocating mechanism is in the state shown in FIG. 1 wherein the push plate 7 is in the furthest position from the accumulating box 12 and the space between the push plate 7 with the channel members 13*a* and 13*b* defining passage for the bill.

A lever 20 is provided at the corner of the L-shaped passage 3 with one end thereof projecting into the passage 3. The lever 20 is pushed by a bill advancing in a forward direction (the bill accepting direction) to automatically withdraw out of the passage 3, whereas the lever 20 serves as a stopper to a reversely moving bill. A sensor S2 is provided for detecting the movement of the lever 20. The sensor S2 is turned on when the lever 20 has moved out of the passage as indicated by chain-and-dot-line 20' and is turned off when it has moved in the passage 3.

When the sensor S1 has detected the insertion of the bill, the conveying motor M1 is forwardly rotated to convey the inserted bill in the forward direction along the passage 3. In the course of the forward passing of the bill, the discrimination of the bill as to whether it is true or not is made on the basis of the outputs of the magnetic heads H1 and H2. If the bill has been found to be a counterfeit one, the motor M1 is reversely rotated to return the bill. When the rear end of the bill which has been finally judged to be a true bill and thereupon fed forwardly has passed by the lever 20 and the switch S2 has been turned off, a true bill signal is delivered to an external device which utilizes this signal for counting the number of deposited bills. Upon lapse of a predetermined period of time, the forward rotation of the motor M1 is stopped and the inserted bill is stopped in a position opposite to the push plate 7. Then the motor M2 is forwardly rotated to effect the bill accumulating operation in which the bill is taken in the box 12. A carrier switch S3 is provided on the rotation shaft of the motor M2 to rotate the motor M2 by one rotation during the accumulating operation. The eccentric cam 8 rotates once in accordance with one rotation of the motor M2 to reciprocate the push plate 7 once.

Figure 3:
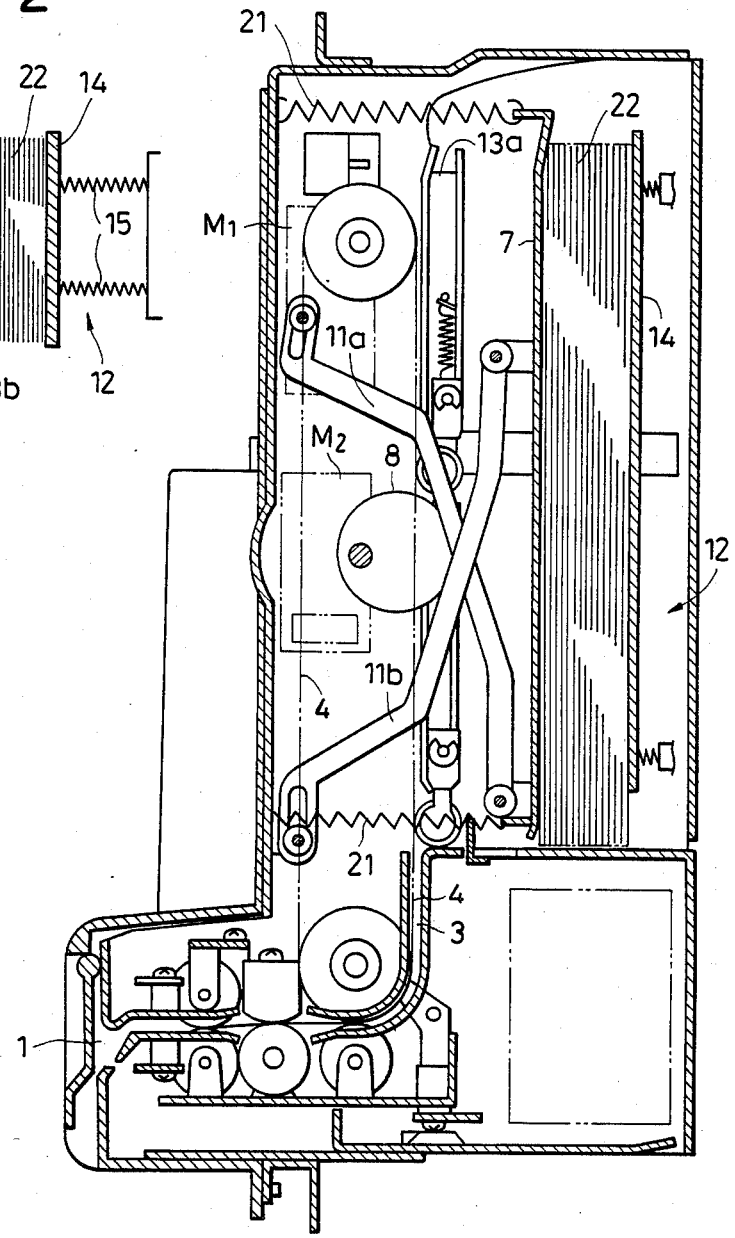
FIG. 3 is a sectional side view showing the same embodiment during the bill accumulating operation.

As the push plate 7 approaches the compression plate 14, the push plate 7 passes between the channel members 13*a* and 13*b* pushing the bill from the passage 3 (at this time the bill passes between the channel members 13*a* and 13*b* in a flexed state) and, pressing the bill against the compressing plate 14, moves the compressing plate 14 against the force of the spring 15 in the direction of arrow A. There is produced space between the channel members 13*a* and 13*b* and the compression plate 14 and the pushed bill enters this space. FIG. 3 shows a state in which the reciprocating means has translated by the maximum amount. At this time, the offset cams 8 have rotated by half rotation. When the offset cams 8 rotate by another half rotation, the push plate 7 returns in the direction of arrow $\overline{A}$ and the compression plate 14 is pushed by the spring 15 toward the channel members 13*a* and 13*b*. When the two sides of the bill come into abutting contact with the channel members 13*a* and 13*b*, the movement of the compression plate 14 stops and the bill is compressed and held between the members 13*a* and 13*b* and the compression plate 14. The push plate 7 returns to the original position leaving the held bill in the box 12. Thus, a large number of bills 22 are accumulated between the channel members 13*a* and 13*b* and the compression plate 14 in the box 12.

Figure 4:
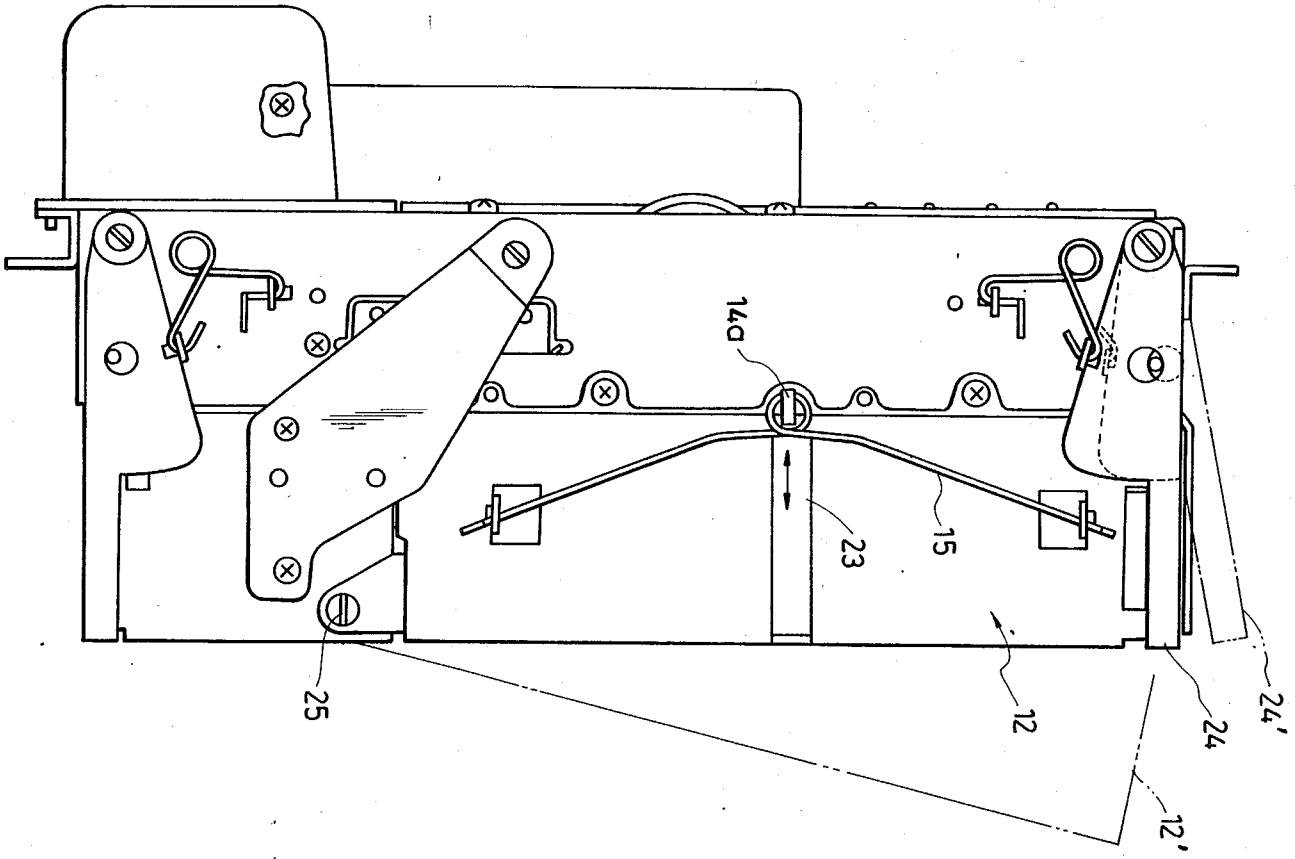
FIG. 4 is a side view of the same embodiment.

FIG. 4 is a side view of the above described bill device showing that the spring 15 actually is mounted on both sides of the box 12. The springs 15 are mounted on projections 14*a* which are provided in the middle of both sides of the compression plate 14 which projections 14*a* move along openings 23 formed in the sides of the box 12. By lifting a latch-type lid 24 mounted on the box 12 as shown by a chain-and-dot line 24', the box 12 can be tilted about a pin 25 as shown by a chain-and-dot line 12' whereby the bills accumulated therein can be readily collected. A safety switch S4 is provided in association with the box 12 to detect disengagement of the box 12 from the main part as shown by 12' so that the rotation of the motor M1 and M2 is inhibited to prevent insertion of bills during the disengagement of the box 12.

An additional deposition of bills should preferably be prohibited while a bill is being accumulated in the box 12 by the rotation of the motor M2. For this purpose, in case the sensor S1 at the bill insertion slit 1 has detected a bill during the rotation of the motor M2, the rotation of the conveying motor M1 is prohibited (or the motor M1 is reversely rotated) to prevent the deposition of a bill.

When the bill accumulating box 12 has become full of bills, further accumulation of bills is no longer possible and further insertion of a bill must be prohibited. For this purpose, some means for detecting the fullness should preferably be provided and the rotation of the conveying motor M1 be prohibited during detection of the fullness. Alternatively, the motor M1 should be reversely rotated to return the bill automatically when the sensor S1 at the bill insertion slit 1 has detected the inserted bill. As the box fullness detection means, a sensor is provided in a predetermined fullness detection position in the box 12. Alternatively, the fact that the accumulated amount has reached maximum can be found by detecting that load exceeding a predetermined value has been applied to the accumulating motor M2. The application of load exceeding a predetermined value to the motor M2 can be found by detecting whether or not the carrier switch S3 has maintained the on-state exceeding a predetermined period of time, for the compression plate 14 ceases to move in the direction of the arrow A when the accumulated amount has reached its limit and the rotation of the motor M2 is stopped half way. In this case, the motor M2 should preferably be reversely rotated to restore the standby state as shown in FIG. 1.

Figure 5:
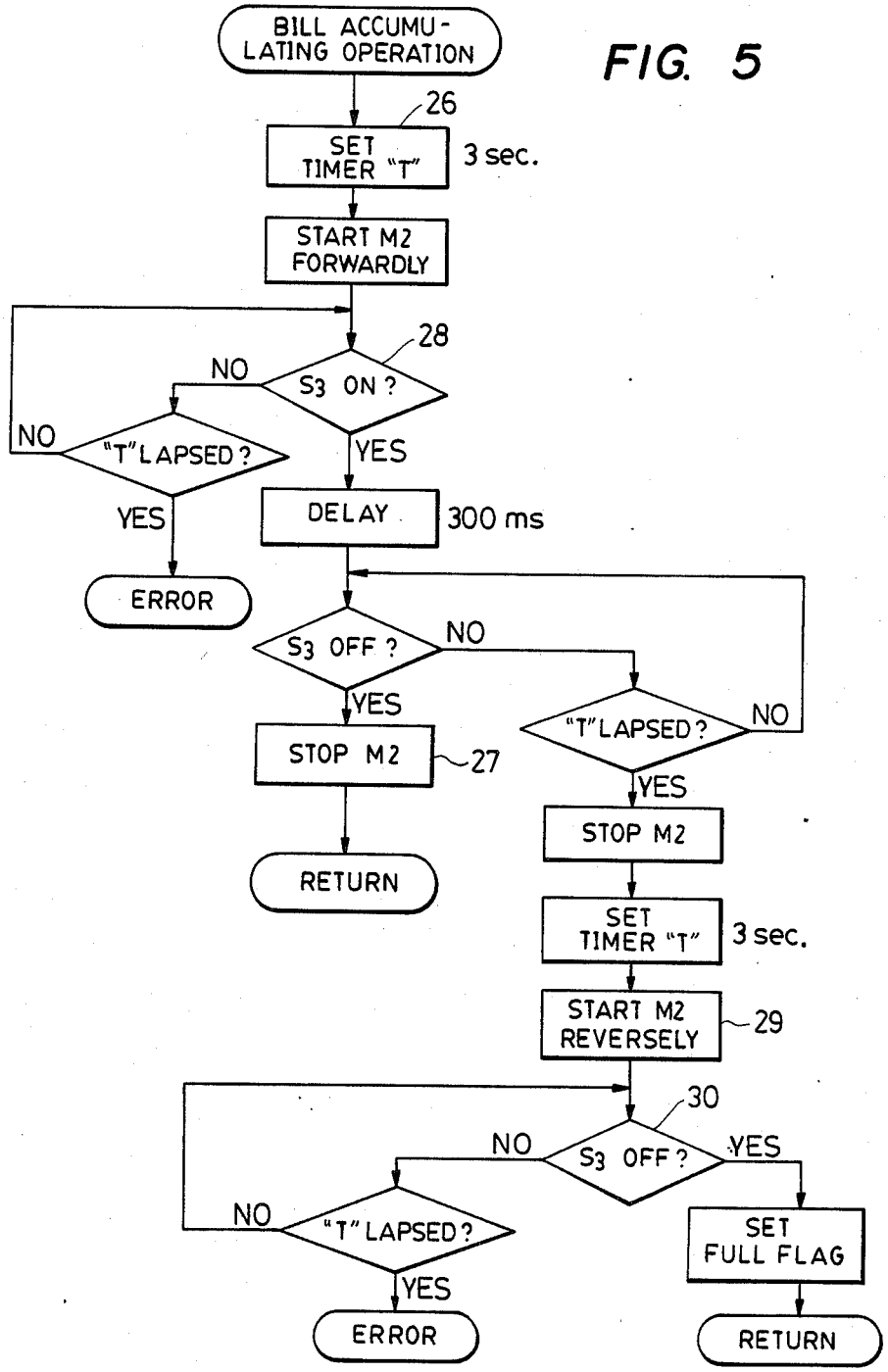
FIG. 5 is a flow chart showing an example of a control program of the bill accumulating operation in the same embodiment.

FIG. 5 shows an example of a control program of the bill accumulating operation. This operation includes means for detecting overload of the motor M2 by the above described timer (i.e., the detection of fullness of the box 12). First, a timer T of 3 seconds is started (block 26) to rotate the motor M2 forwardly. Flow from block 26 to block 27 is a normal control in which the carrier switch S3 is turned on and off within the timer time. In a case where the switch S3 is not turned off within the timer time (block 28 YES), the motor M2 is stopped, the timer T is set again and the motor M2 is reversely rotated (block 29). Upon confirming that the carrier switch S3 has turned off (block 30 YES), a fullness detection flag is set. Upon setting of this flag, a predetermined fullness display is performed to prohibit insertion of a bill.

As described above, since, according to the invention, the bill conveying passage is constructed in an L-shape and bill discrimination means is provided in the short straight portion while reciprocating means for bill accumulation is provided on one side of the long straight portion and the accumulating box on the other side of the long straight portion, the whole bill device can be made compact and therefore it is very advantageous in both mounting space and manufacturing cost.

What is claimed is:

1. A bill device discriminating an inserted bill and thereafter accumulating and storing an accepted bill characterized in that said bill device comprises a main part made of an elongated casing, a bill insertion slit formed at an end portion of a front panel of the casing, a bill conveying passage of an L-shape provided in the casing and communicating with the bill insertion slit for conveying a bill in the longitudinal direction, bill discrimination means provided in a short straight portion of the bill conveying passage nearer to the bill insertion slit, reciprocating means provided on one side of a long straight portion of the bill conveying passage for effecting a bill accumulating operation and a bill accumulating box provided on the other side of the long straight portion of the bill conveying passage for accumulating bills pressed toward it by the reciprocating means, wherein:

said bill conveying passage comprises a pair of bill conveying belts and a first motor for driving these belts;

said reciprocating means comprises a push member for pushing the bill having been brought by the conveying belts in the direction of the face of the bill and a mechanism for reciprocating said push member in accordance with the rotation of a second motor; and said bill accumulating box has an entrance having a width which is somewhat narrower than the width of the bill and a chamber having a size at least adapted to the size of the bill, and wherein said mechanism comprises:

said second motor;

a pair of cams mounted eccentrically on a rotation shaft of the second motor; and a pair of link levers which are pivotally connected at one ends to said push member and connected at the other ends to fixed pins through slots respectively provided at these ends;

said cams rotate eccentrically according to the rotation of the second motor to push said link levers thereby moving said push member in a translation motion in the direction of the face of the bill.

2. A bill validator, comprising:

a vertically elongated casing, a bill insertion slot on the lower front of said casing, validation sensors, means within said casing for conveying an inserted bill rearwardly and upwardly past said validation sensors, an accumulation box forming part of the mid and upper rear of said casing, said accumulation box including a rear channel shaped portion, said channel spaced portion being rotatable backward to permit removal therefrom of an accumulated stack of bills, and push plate means within said casing for translating a true validated bill, after upward conveyance, rearwardly into said accumulator box.

3. A bill validator according to claim 2 wherein the bottom rear of said channel shaped portion is pivotally attached to the rear of said casing, the upper end of said channel shaped portion thereby being rotatable away from said rear of said casing to permit the removal of the accumulated stack of bills from the top end of said channel shaped portion.

4. In a bill validator in which a bill is linearly conveyed along a path past validation sensors, the improvement comprising:

an accumulating box, a pair of spaced parallel stationary members extending along respective opposite edges of said bill path on one side of said accumulation box, there being a space between said pair of spaced stationary members sufficiently large to permit the bent insertion therethrough of a bill into said accumulating box, a spaced parallel pair of driven belts extending on respective opposite elongated edges of said bill path, the longitudinal edges of a bill being conveyed along said path by said pair of driven belts, and biased roller means mounted to said respective spaced parallel stationary members, and including springs, for exerting a pressure on said conveyed bill toward said belts, and pusher means, mounted on the opposite side of said belts as said accumulating box and movable across said bill path, for pushing a conveyed bill through the space between said spaced parallel support members into said accumulating box.

5. In a bill validator through which a bill is conveyed along a bill conveying passage from an insertion slit past validation sensors and to an accumulation area, the improvement comprising:

a housing, a lever pivotally mounted within the housing of said validator, one end of said lever normally across said passage, said lever being configured so tha a bill transported past said lever will push the same out of the passage, a switch actuated by said lever when pushed out of said passage, said lever being situated so that said lever will be pushed and said switch will be atcuated only while said bill is being validated by said validation sensors, and means for conveying said bill completely past said lever only after said bill has been validated as being a true bill, the subsequent return of said lever to said position across said bill conveying passage preventing the return of said validated true bill to said bill insertion slot.

6. The bill validator of claim 5 together with means for sending a true bill signal to a utilization device only after said bill has been validated as a true bill and said bill has been conveyed completely past said lever and said switch has been deactuated.

7. A bill accepting device of the type in which a bill is conveyed along a bill passage past validation sensors to a bill accumulation section of said device, said bill accumulating section comprising:

a unitary solid bill compressing plate situated within said section and biased toward said bill passage to compress bills in a neat pressed stack, ram means, having a motor and operative in a single stroke of single fixed excursion distance, for forcing a bill situated in said passage in a direction normal to the plane of said bill through an opening into said bill accumulating section and onto and against a flat stack of bills previously accumulated on said bill compressing plate, said bill compressing plate thereby compressing and holding said additional bill and accumulated stack neatly against elongated edge channel members defining said opening upon return reciprocation through said fixed excursion distance of said ram means, and motor load sensor means, cooperating with said ram means, for sensing by a resultant increased load on the motor of said ram means that a maximum amount of bills have been accumulated in said stack, and wherein said motor load sensor means comprises:

a timer started at the beginning of said stroke of said ram means, said timer having a timing duration generally corresponding to the amount of time normally requried for said motor to drive said ram means through said stroke of single fixed excursion distance including said return reciprocation, carrier switch means, cooperating with said motor, for providing a signal indicating that said motor has rotated sufficiently to complete driving of said ram means through said stroke of single fixed excursion distance including said return reciprocation, control means, cooperating with said timer and said carrier switch means, for ascertaining when said provided signal has not occurred prior to the completion of said timing duration, thereby indicating that said ram means has not traveled through said fixed excursion distance within a certain prescribed time interval, and means, cooperating with said control means, for counter-rotating said motor to withdraw said ram means in the event that said ram means has not traveled through said fixed excursion distance within said prescribed time interval.

* * * * *